United States Patent [19]

Hadgis

[11] 4,287,736

[45] Sep. 8, 1981

[54] KEY RING CLIP LOCK FOR PUMP HANDLES

[76] Inventor: Gregory S. Hadgis, 14078 Zaremba Dr., Brookpart, Ohio 44142

[21] Appl. No.: 32,296

[22] Filed: Apr. 23, 1979

[51] Int. Cl.[3] ..... A47G 29/10

[52] U.S. Cl. ..... 70/458; 141/392

[58] Field of Search ..... 70/456 R, 456 B, 457, 70/458, 459; 248/339, 340, 341; 24/3 K, 3 D, 230.5 W, 230.5 TP; 141/392, 206, 1

[56] References Cited

U.S. PATENT DOCUMENTS

| | | | |
|---|---|---|---|
| 595,693 | 12/1897 | Cameron | 24/230.5 W |
| 1,333,655 | 3/1920 | Davis . | |
| 2,564,242 | 8/1951 | Wendt . | |
| 2,777,180 | 1/1957 | Keating | 70/458 |
| 2,994,462 | 8/1961 | Hirsch . | |
| 3,346,150 | 10/1967 | Clopton . | |
| 3,469,710 | 9/1969 | Vosbikian | 248/341 |
| 3,579,746 | 5/1971 | Marik | 24/230.5 W |
| 4,073,457 | 2/1978 | Batts | 248/340 |
| 4,095,629 | 6/1978 | Jordon . | |
| 4,200,128 | 4/1980 | Pokrzywa | 141/392 |

*Primary Examiner*—Robert L. Wolfe

*Attorney, Agent, or Firm*—Maky, Renner, Otto & Boisselle

[57] ABSTRACT

A key ring clip lock apparatus for holding the plunger of a gas pump handle in a positional mode for automatic pumping operation has a key holding portion for directly holding keys or the like thereon, including a resiliently deformable portion for permitting opening and closing of the key holding portion to receive and to remove such keys or the like, and a clip-like portion for grabbing part of the pump handle to hold the apparatus thereto with the plunger in a substantially compressed, valve-open position so as to allow hands-off gas pumping operation of an associated gas pump. In a preferred embodiment the apparatus is a formed rigid metal wire with first and second rigid lengths, one being concave curved with respect to the other, and a connecting length securing them in relatively fixed positions spaced apart a distance adequate to accommodate at least part of the plunger and pump handle with the plunger in an automatic pumping positional mode, and the key holding portion is formed of a rebent extension of the second rigid length providing a useful lever arm to facilitate placing and removing keys and to provide an enlarged effective surface to facilitate manual manipulation and use of the apparatus.

20 Claims, 7 Drawing Figures

KEY RING CLIP LOCK FOR PUMP HANDLES

BACKGROUND OF THE INVENTION

The present invention relates generally, as indicated, to apparatus for holding the plunger of a gas pump handle in a positional mode for automatic pumping operation and, more particularly, to a key ring clip lock for pump handles which provides a duality of function including the convenient holding of keys, i.e. a key ring type function, and the facilitating of pumping gas, with a cooperation therebetween, as is described in further detail below.

With the advent of rising energy costs and the desire for reduction in expenditures therefor, the popularity of self-service gas pumps for automobiles has experienced a dramatic increase.

In the past, typical pump handles for gas pumps have had a manually depressable plunger which operates a valving mechanism to permit the flow of gas from the gas pump for discharge through the handle to a vessel or tank, such as a typical automobile gas tank. Usually, a flow pressure sensor mechanism associated with the valving mechanism automatically closes the latter, even though the pump handle is still depressed, to stop gas flow when the vessel has filled. Therefore, when the plunger is so depressed it may be considered to be placed in a positional mode for automatic pumping of gas, whereby automatic termination of gas flow occurs to avoid spilling of gas. Moreover, to facilitate pumping gas and to free a service station attendant to perform additional functions while gas automatically is pumped into a vessel, locking mechanisms have been provided in the past to lock the plunger of the pump handle in a positional mode for automatic pumping.

A disadvantage of present self-service gas stations is that the above mentioned lock mechanism usually is removed from the pump handle. Consequently, the customer must stand at the automobile gas tank and must continuously depress the pump handle plunger to place the same in a positional mode for automatic pumping of gas until the plunger is released or the valve mechanism automatically stops gas flow. In inclement weather, however, the requirement for continuous manual depressing of the pump handle plunger is inconvenient and bothersome, and during all types of weather is tiresome to one's hand holding a plunger for more than a short period of time; the latter being an especially critical disadvantage insofar as arthritic people are concerned.

Furthermore, for safety it is desirable that the engine of a vehicle be stopped while pumping gas into the vehicle gas tank. This safety requirement is all the more important in self-service gas stations, for to leave an engine operating with the operator's position unattended while the operator is outside pumping gas is especially dangerous and all the more so when, for example, young children are left in the vehicle.

SUMMARY OF THE INVENTION

It is, accordingly, a primary object of the present invention to provide a strong key ring clip lock apparatus that both facilitates pumping gas in self-service stations and encourages the removal of a vehicle ignition key to stop an engine while gas is pumped into a vehicle gas tank.

Another object is to hold the gas pump handle in a positional mode for automatic pumping of gas.

An additional object is to facilitate pumping of gas.

A further object is to facilitate manual manipulation and use of a formed wire clip lock apparatus to hold a gas pump handle in a positional mode for automatic pumping of gas.

Still another object is to provide a secure key holding mechanism.

Still an additional object is to combine for convenience and safety in connection with an automobile a holder for automobile and/or other keys and a clip lock for facilitating pumping of gas into the automobile gas tank.

Still a further object is to reduce the tendency to leave a vehicle ignition key in the ignition while the vehicle is stopped for pumping gas, thus assuring that the engine is off, especially by providing a combination key ring clip lock apparatus on which such key is held and which is used to facilitate self-service pumping of gas.

As used herein the terms "vehicle" and "automobile" are used interchangeably as examples with which the invention may be associated for facilitating the pumping of gas into the gas tank of the same or other apparatus, e.g. boats, other gas tanks, etc.

The foregoing and other objects and advantages of the present invention, as will become more apparent from the following detailed description of the invention, are accomplished, briefly, by a key ring clip lock apparatus for pump handles comprising holding means for directly holding keys or the like, the holding means including a resiliently deformable portion for permitting opening of the holding means to receive and to remove keys therefrom, and a clip means cooperative with the holding means for holding the apparatus to a gas pump handle normally to keep the plunger thereof in an automatic pumping positional mode. According to a preferred embodiment of the invention, the apparatus is comprised of a formed rigid metal wire having first and second rigid lengths and a connecting length securing the two in relatively fixed position spaced apart a distance adequate to accommodate at least part of a gas pump plunger and pump handle with the plunger in an automatic pumping positional mode, such apparatus having adequate strength and rigidity to hold the plunger in such positional mode and being cooperative with the resilient reaction force of the plunger to hold the apparatus on the pump handle. Moreover, the clip portion preferably is curved for secure grabbing of part of the pump handle with minimum scratching or scraping of either.

To the accomplishment of the foregoing and related ends, the invention, then, comprises the features hereinafter fully described in the specification and particularly pointed out in the claims, the following description and the annexed drawing setting forth in detail a certain illustrative embodiment of the invention, this being indicative, however, of but one of the various ways in which the principles of the invention may be employed.

DESCRIPTION OF THE PREFERRED EMBODIMENT

Figure 1:
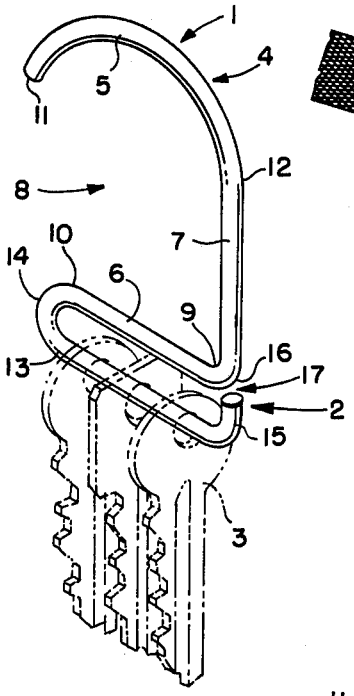
FIG. 1 is an isometric view of a key ring clip lock apparatus in accordance with the present invention.

Referring now in detail to the drawing, wherein like reference numerals designate like parts in the several figures, and initially to FIGS. 1–6, a key ring clip lock apparatus in accordance with the present invention is generally indicated at 1. The fundamental parts of the apparatus 1 include a key holder portion 2 for directly holding one or more keys shown in phantom at 3 and a clip-like portion 4 which is intended to cooperate with the key holder portion to hold or to grab a pump handle in a manner illustrated, for example, in FIG. 7.

As used herein, the terms "upper", "lower", "left" and "right", and obvious variations thereof, refer to the illustrations in the drawing when viewed in a normal logical sense for convenience of description. However, it will be appreciated that the apparatus 1 may be employed in other orientations than that illustrated in the drawing.

Preferably the apparatus 1 is a formed wire which is relatively inexpensive while capable of adequate strength and rigidity for the intended purpose with adequate resilience particularly at the key holder portion to enable facile placement and removal of keys thereon. The key ring also may comprise a metal stamping or be made of a material other than metal, such as plastic; however, metal is preferred for its over-all strength and resilient characteristics. Morover, preferably the formed wire apparatus 1 is steel or like metal material with an adequate coating or plating thereon, such as chrome, to resist corrosion or other deterioration of the metal. Alternatively, a plastic, plastic-like, rubber, rubber-like, or other similar material may be used as a coating of the metal apparatus 1 for protective, appearance, and/or other purposes.

Figure 7:
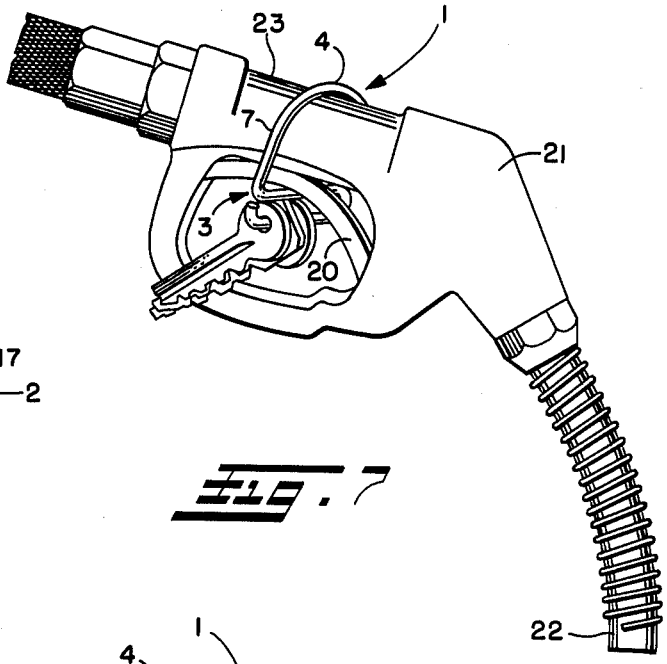
FIG. 7 is an isometric environmental view depicting use of the key ring clip lock apparatus to hold the plunger of a gas pump handle in a positional mode for automatic pumping of gas.
Figure 5:
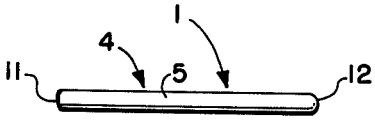
FIGS. 2–6 are, respectively, front, open side, closed side, top, and bottom views of the key ring clip lock apparatus of FIG. 1.
Figure 3:
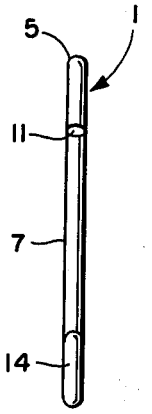
Figure 2:
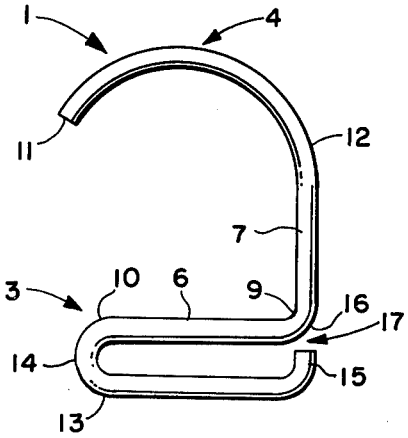
Figure 4:
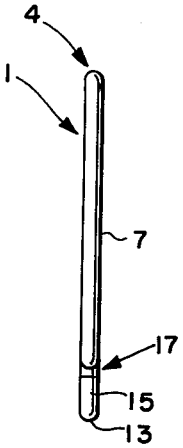
Figure 6:
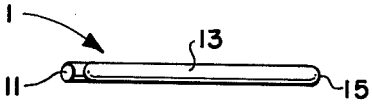

The clip portion 4 of the apparatus 1 preferably is a first length 5 of the formed wire; the key holder portion 2 includes a second length portion 6 of the formed wire preferably of a linear dimension greater than the width of a typical gas pump handle plunger, and the two portions are coupled in relatively fixed spatial relation by a connecting length 7 of the formed wire. The space 8 between the length portions 5 and 6 at the open side of the apparatus 1, i.e. opposite the connecting length 7, is adequate to contain at least part of a pump handle and a depressed plunger of a gas pump, as is seen in FIG. 7, for example. The first and second lengths 5, 6 may be parallel or acute, straight or curved, as desired. However, in accordance with the preferred embodiment and best mode of the invention, the second length 6 is straight and the first length 5 is curved or hook-like with the approximate center of curvature coinciding approximately with an axis parallel to the connecting length 7, i.e. about perpendicular to the second length 6, and between the ends 9, 10 of the second length 6, with the most preferred form having such axis approximately one-fourth to three-fourths the way along the second length 6.

Moreover, the diameter or chord of the curved hook-like first length 5 of the clip portion 4, i.e. the distance from the end 11 to the approximate juncture 12 with the connecting length 7 is about the same as the linear extent of the second length 6 between its ends 9, 10.

Thus, the rigid apparatus 1, including the lengths 5, 6, 7 thereof, are conveniently secured to and automatically held in position on a pump handle in the manner illustrated in FIG. 7 with the resilient reaction force of the pump handle plunger, which is held in a positional mode for automatic pumping, further cooperating with the apparatus 1 to hold the same on the pump handle. The curvature of the clip portion 4 improves the integrity of the grabbing or holding action of the apparatus 1 on the pump handle so that the apparatus 1 will tend not to fall off regardless of orientation. The curvature of the length 5 preferably is adequate to handle most conventional size pump handles; it is better that the radius of curvature of length 5 and linear distance between its ends, i.e. the noted chord, be slightly larger than the radius of curvature and diameter, respectively, of the part of the pump handle to which it is ordinarily abutting than too small with respect to the same.

The key holder portion 2 includes, in addition to the second length 6, a rebent extension 13 of the formed wire. Such rebent extension has a curved connection 14 by which it joins the second length 6, preferably is generally coextensive with the second length 6, and has an upturned end 15, which cooperates with the juncture 16 of the second length 6 and the connecting length 7 to lock the keys in the key holder portion 2 providing a relatively minimal clearance space 17 therebetween. The rebent extension 13 has a plurality of functions including the providing of a support for keys 3 and providing of a lever arm that facilitates resilient bending or deforming of the key holder portion 2, particularly about the curved portion 14 briefly to enlarge the clearance 17 to facilitate placing and removing keys with respect to the key holder portion 2. An additional function of the rebent extension 13, which is generally parallel and coextensive with the second length 6, is the facilitating of manual manipulation and use of the apparatus 1. Thus, although the formed wire of which the apparatus 1 preferably is comprised would ordinarily be relatively difficult to manipulate manually over a single diameter thereof, the parallel coextensive second length 6 and rebent extension 13 in effect provide a relatively large area that can be conveniently manually held by a user.

With the apparatus 1 made from a formed wire, such wire has a generally circular cross-section, thus minimizing any sharp edges that might injure a user, damage clothing, etc. Moreover, preferably the end 10 of the first length 5 is beveled to eliminate any sharp edges, and the end face of the upturned end 15 also may be similarly beveled.

The key ring clip lock apparatus 1 may be used in the manner illustrated in FIG. 7. Thus, with an automobile ignition key, for example, attached to the key holder portion 2, whenever the user wishes to use the apparatus 1 to facilitate pumping gas, the ignition key must be removed from the ignition, thus encouraging the user to stop the vehicle engine before pumping gas. The plunger 20 of the gas pump handle 21 is manually depressed with one hand while the discharge spout 22 is in a gas fill opening of a gas tank, for example, and the clip portion 4 of the apparatus 1 is placed over the portion 23, which in many instances is curved, as shown, of the pump handle 21. At this time the key holder portion 2, and, particularly, the second length 6 may be pointed generally in a downward direction. Thereafter, the apparatus 1 is rotated slightly to place the second length 6 in a generally horizontal position, as is shown in FIG.

7, and the plunger 20 is released. The apparatus 1 holds the plunger in positional mode for automatic pumping of gas from the pump handle 21 until the automatic mechanism in the pump handle 21 shuts off flow or until the apparatus 1 is removed and the plunger 20 is released.

I claim:

1. A key ring clip lock apparatus for pump handles and their plungers, or the like, comprising holding means for directly holding keys or the like, said holding means including a resiliently deformable portion for permitting opening of said holding means to receive and to remove keys or the like; and clip means cooperative with said holding means for holding the apparatus to a gas pump handle and for confining between said holding means and said clip means at least a portion each of the pump handle and of the plunger thereof in an automatic pumping positional mode normally to retain the plunger in such mode.

2. The apparatus of claim 1, wherein said apparatus comprises a formed metal wire of sufficient thickness to give the apparatus adequate strength and rigidity for holding the plunger in the automatic pumping positional mode, said wire having a diameter sufficiently small for placing keys thereon.

3. The apparatus of claim 1 or 2, said holding means comprising parallel arms joined at one end thereof.

4. The apparatus of claim 3, the other end of a first one of said arms having an upturned portion facing a second one of said arms, a clearance space between an edge of said upturned portion of relatively small dimension to avoid release of keys therebetween, and said one arm forming a lever arm to facilitate application of force to deform said holding means at the junction of the ends of said arms thereby to enlarge said clearance space to permit passage of keys therethrough for direct mounting on said holding means.

5. The apparatus of claim 4, further comprising curved means for integrally joining said first and second arms.

6. The apparatus of claim 1, further comprising connecting means for connecting said holding means and said clip means, said holding means including a substantially linear arm and said connecting means comprising a further linear arm generally perpendicular with respect to the former arm.

7. The apparatus of claim 1 or 2, said clip means comprising a curved arm openingg concavely toward said holding means for engaging the pump handle with the concave side of said curved arm.

8. The apparatus of claim 7, said curved arm having an approximate radius of curvature with a center of such curvature being positioned approximately on an axis that is approximately perpendicular to said holding means.

9. The apparatus of claim 8, said holding means comprising a pair of generally parallel arms generally coplanar with said clip means, one of said parallel arms forming a rebent extension of the other and said parallel arms being joined by a curved length at one end thereof, and said center of curvature being approximately on an axis that extends perpendicularly from about one-fourth to about three-fourths of the length of one of said arms of said holding means.

10. The apparatus of claim 9, further comprising rigid connecting means generally coplanar with said arms and clip means for securing said clip means and said holding means in fixed relative positions spaced apart from each other with the linear dimension between opposite ends of said curved arm of said clip means being approximately the same, parallel, and coextensive with respect to that of one of said parallel arms of said holding means, one of which parallel arms is closer to said curved arm than is the other of said parallel arms, and which closer parallel axis is for engaging and retaining the plunger in its automatic pumping positional mode.

11. An apparatus for holding the plunger of a gas pump handle in an automatic pumping positional mode, comprising a formed rigid metal wire having first and second rigid lengths and a connecting link generally coplanar with and securing said first and second lengths in relatively fixed positions spaced apart a distance adequate to confine between them at least a part each of the plunger and pump handle with the plunger in an automatic pumping positional mode, the apparatus having adequate strength and rigidity to hold the plunger in such positional mode and being cooperative with the resilient reaction force of the plunger to hold the apparatus on the pump handle.

12. The apparatus of claim 11, said length being substantially linear and said first length being substantially concave with respect to said send length, which second length is for engaging the plunger and which first length is for engaging the pump handle.

13. The apparatus of claim 12, said connecting length being connected to respective ends of said first and second lengths and extending substantially perpendicularly with respect to said second length.

14. The apparatus of claim 13, the approximately direct linear distance between the ends of said first length being approximately the same as the linear distance between the ends of said second length, and wherein the major directional extents of said first and second lengths are generally parallel and coextensive.

15. The apparatus of claim 11, further comprising holding means for directly holding keys or the like, said holding means including said second length and a rebent extension of said second length extending generally parallel and substantially coextensive with said second length, an upturned end portion on said extension facing said second length to define a small space therewith normally too small to pass keys therethrough, and curved means for resiliently joining said second length and said rebent extension to permit temporary enlarging of said space in response to an applied force to permit the passage of keys therethrough for mounting on said extension, said rigid metal wire having a diameter sufficiently small for placing keys thereon.

16. The apparatus of claim 11, further comprising a rebent extension means of said second length integrally coupled to and extending generally parallel, substantially coextensive, and spaced apart from said second length for facilitating manual manipulation of the apparatus.

17. The apparatus of claim 11, 12, 13, 14, 15 or 16, said first length comprising a curved arm.

18. The apparatus of claim 17, said curved arm having an approximate radius of curvature with a center of such curvature being approximately on an axis that is approximately perpendicular to said second length.

19. The apparatus of claim 18, said center of radius being approximately on an axis that extends perpendicularly from about one-fourth to about three-fourths along the length of said second length.

20. The apparatus of claim 18, said curved arm being relatively gradually curved so as to avoid damaging the pump handle while assuring relative secure grabbing thereof.

* * * * *